US008562035B2

(12) United States Patent
Burdenko et al.

(10) Patent No.: US 8,562,035 B2
(45) Date of Patent: Oct. 22, 2013

(54) SELF-ALIGNING SAFETY LOCK

(75) Inventors: Michael N. Burdenko, Wellesley Hills, MA (US); Dennis C. Mackey, Hamilton, MA (US); Richard Galera, Nashua, NH (US); Steven Tambeau, Marlborough, MA (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 64 days.

(21) Appl. No.: 12/946,822

(22) Filed: Nov. 15, 2010

(65) Prior Publication Data

US 2012/0119523 A1 May 17, 2012

(51) Int. Cl.
*E05C 19/16* (2006.01)
*E05C 17/56* (2006.01)

(52) U.S. Cl.
USPC ..... 292/251.5; 292/340; 292/DIG. 15

(58) Field of Classification Search
USPC ..... 292/251.5, 340, 341.15, 341.18, 292/DIG. 15
See application file for complete search history.

(56) References Cited

U.S. PATENT DOCUMENTS 3,155,409 A * 11/1964 Schlissel ..... 292/251.5
3,872,696 A * 3/1975 Geringer ..... 70/145
3,884,514 A * 5/1975 Praska ..... 292/11

* cited by examiner

*Primary Examiner* — Carlos Lugo
*Assistant Examiner* — Mark Williams
(74) *Attorney, Agent, or Firm* — Turocy & Watson, LLP; William R. Walbrun; John M. Miller

(57) ABSTRACT

A safety lock mechanism is provided that facilitates accurate and consistent alignment between a locking bolt and a locking receptacle prior to engaging the locking bolt. To this end, a safety lock configured to mount to a door frame is provided with an internally disposed hard stop that protects the electrical and mechanical components within the safety lock housing from door impact shock. An extended portion of the hard stop protrudes through the housing facing the direction of door travel. A corresponding receptacle assembly configured to mount to the door is fabricated to include a bolt receptacle hole as well as an open window that engages with the extended portion of the hard stop when the door is in the closed position. When the window in the receptacle is engaged with the extended portion of the hard stop, door movement is limited in five directions even when the locking bolt is not yet engaged. An optional magnet embedded in the hard stop can limit door movement in the sixth direction by magnetically latching to a striking plate mounted behind the window. Thus, the window and the hard stop pre-position the receptacle for proper alignment between the locking bolt and the locking bolt receptacle, ensuring that the locking bolt will properly engage with the receptacle when advanced.

20 Claims, 10 Drawing Sheets

SELF-ALIGNING SAFETY LOCK

TECHNICAL FIELD

The claimed subject matter relates generally to safety locking mechanisms, and in particular to safety locks having incorporated receptacle alignment features to facilitate accurate locking bolt engagement.

BACKGROUND

Modern industrial facilities can include a number of hazardous areas that should only be accessed when certain safe conditions within the areas are met. These can include areas in which potentially dangerous automated machinery is running. Such areas are typically enclosed within protective structures (e.g., safety cages) having one or more lockable access doors or gates. To ensure that these access doors cannot be opened during unsafe operating conditions, many access doors incorporate electrically actuated locking mechanisms that can be either manually or automatically engaged. Solenoid-driven bolt-actuated safety locks represent one example of such a controllable door lock. These solenoid-driven locks can comprise a locking mechanism (often mounted on the door frame) having a linearly actuating bolt that either advances or retracts when the associated solenoid is energized, and a receptacle (mounted on the door itself) having an opening that receives the bolt when advanced, thereby locking the door.

Bolt-actuated locks such as those described above require accurate alignment between the bolt and the receptacle before the lock can be successfully engaged. However, there are a number of mechanical factors that can hinder proper alignment of the bolt and receptacle. For hinged doors, the swinging of the door on its hinge allows free travel in two directions. Although door frames typically incorporate some type of door stopping mechanism to stop the door at a generally aligned location when in the closed position, the door is still not prevented from drifting to an open position prior to engagement without force being applied against the door manually by an operator. Additionally, excessive door sagging or warping can lead to misalignment in other directions. Sliding safety doors are also prone to lock misalignment, since such doors are susceptible to sideways movement perpendicular to the plane of the door frame. These problems can be particularly troublesome in the industrial settings described above, since the safety gates and doors employed in such environments are sometimes constructed from relatively flexible metal caging or transparent plastic material to allow visibility into the automated processes being executed within the enclosed areas. Since such safety gates lack the rigidity of some other types of doors, accurate lock alignment is rendered more difficult. Moreover, there are a number of general design inefficiencies inherent in typical safety door locking systems, such as the use of separate devices to achieve door stopping, door alignment, and lock alignment.

Bolt actuated locks can also suffer from integrity issues even after the bolt is engaged with the receptacle. Since the stroke of the bolt used to lock the door can be relatively short, such locks can conceivably be bypassed by exerting enough force on the door in the direction of the bolt's stroke to slip the receptacle off the bolt and disengage the lock.

Given the problems described above, there is a need for a safety lock design that ensures consistent and accurate alignment between the locking bolt and the receptacle in all six directions without the need for manual trial-and-error positioning by an operator. It would also be beneficial to improve the overall integrity of bolt-actuated locks such that the lock cannot be bypassed by slipping the receptacle off the end of the bolt while in the locked position.

SUMMARY

The following presents a simplified summary in order to provide a basic understanding of some aspects described herein. This summary is not an extensive overview nor is intended to identify key/critical elements or to delineate the scope of the various aspects described herein. Its sole purpose is to present some concepts in a simplified form as a prelude to the more detailed description that is presented later.

One or more embodiments of the present disclosure relate to a safety lock that ensures proper alignment between the locking bolt and the corresponding receptacle in all six directions. To this end, a safety lock is provided that mounts to a door frame and includes a solenoid-driven locking bolt that advances from the bottom of the lock to engage with an opening in a receptacle mounted on the safety door or gate. To ensure proper alignment of the locking bolt with the receptacle opening prior to engagement, the safety lock can include a hard stop having a portion that extends from the face of the safety lock housing facing the door's line of travel. A cutout or window on the receptacle receives this hard stop extension when the door is in the closed position. The window can be sized slightly larger than the extended hard stop to allow a degree of clearance between the edges of the window and the sides of the hard stop extension. When the hard stop on the safety lock is engaged with the window on the receptacle, movement of the door that can cause misalignment of the receptacle is limited in four directions (generally the plane parallel with the front surface of the safety lock housing). The hard stop itself limits movement of the door in a fifth direction (toward the safety lock). An optional magnet built into the hard stop can magnetically latch to a ferromagnetic surface located behind the receptacle window, thereby limiting movement of the door in the sixth direction (away from the safety lock), although it is to be appreciated that this magnet may not be necessary in some door configurations to prevent movement in the sixth direction (e.g., doors having horizontal hinges along the top edge door, in which the force of gravity is sufficient to prevent movement of the door away from the safety lock). Thus, while the hard stop is engaged with the receptacle window and within the window's clearances, alignment of the safety bolt with the bolt receptacle is assured.

In some embodiments, the hard stop can reside within the safety lock housing and can span from the front wall of the housing to the rear wall (or to a rear bracket used to mount the safety lock), with the portion that engages with the receptacle window protruding from the front surface of the housing. By designing the hard stop in this way, shock generated by door impact can be transmitted to the door frame or to a supporting bracket that mounts the safety lock thereto, thereby protecting the electromechanical components within the safety lock from shock-related damage. This hard stop can also substantially protect the safety lock housing itself from door impact, which is particularly beneficial for locks having plastic housings. Moreover, designing the safety lock itself to act as the door stop as well as to facilitate alignment of the door can reduce the number of separate components required to achieve accurate door locking (e.g. by eliminating the need for a separate door stop mechanism).

To the accomplishment of the foregoing and related ends, certain illustrative aspects are described herein in connection with the following description and the annexed drawings.

These aspects are indicative of various ways which can be practiced, all of which are intended to be covered herein. Other advantages and novel features may become apparent from the following detailed description when considered in conjunction with the drawings.

DETAILED DESCRIPTION

Figure 2:
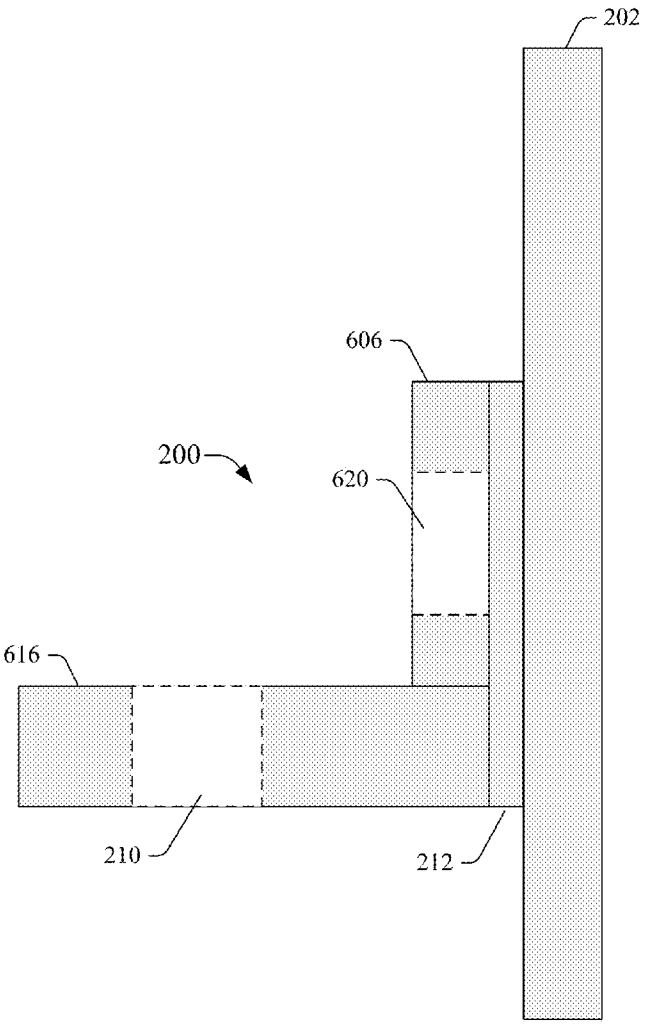
FIG. 2 is a cross-sectional representation of an exemplary receptacle component.

The present invention is now described with reference to the drawings, wherein like reference numerals are used to refer to like elements throughout. In the following description, for purposes of explanation, numerous specific details are set forth in order to provide a thorough understanding of the present invention. It may be evident, however, that the present invention may be practiced without these specific details. In other instances, well-known structures and devices are shown in block diagram form in order to facilitate describing the present invention.

Figure 1:
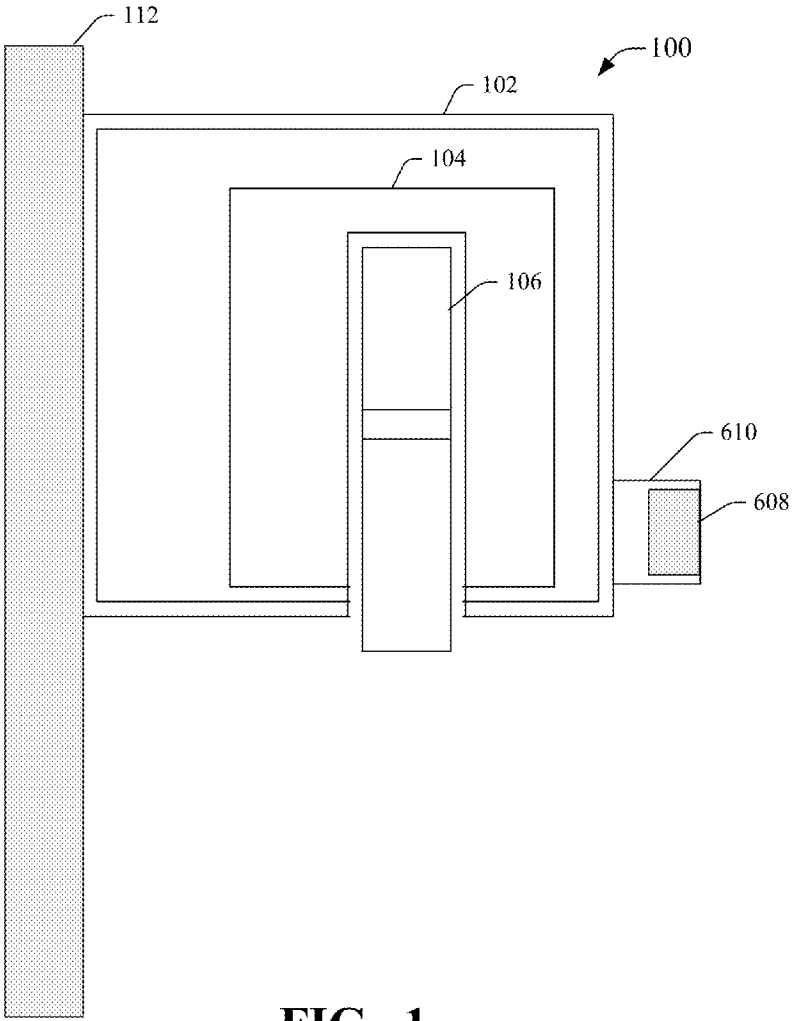
FIG. 1 is a cross-sectional representation of an exemplary bolt-actuated safety lock.

FIG. 1 depicts a cross-sectional representation of an exemplary bolt-actuated safety lock 100 mounted to a door frame 112. Although element 112 is identified as the door frame itself, it is to be understood that element 112 can also be a separate mounting bracket that affixes the safety lock to the door frame. Safety lock 100 comprises a number of electrical and mechanical components disposed within a housing 102 made from a suitable material (e.g., metal, plastic, fiberglass, or other such materials). The safety lock housing 102 can contain a solenoid assembly comprising solenoid 104 and locking bolt 106, wherein solenoid 104 controls the position of locking bolt 106. In some embodiments, solenoid assembly can be a "fail open" type solenoid mechanism, whereby the locking bolt 106 is advanced (that is, extended from the body of the safety lock 100) when solenoid 104 is energized, and returns to a retracted position within the housing 102 when the solenoid is de-energized. Alternatively, the solenoid assembly can be a "fail closed" type mechanism, such that the locking bolt 106 is retracted when solenoid 104 is energized and advanced when energy is removed. It is to be appreciated that the present innovation is not limited to the types of solenoid-driven locking mechanisms described above, and that any suitable solenoid-driven locking bolt can be employed in the subject safety locking system. Moreover, although FIG. 1 and the description herein depicts a locking bolt driven by a solenoid, any suitable mechanism that serves to stroke a locking bolt between an advanced and a retracted state can be employed in the subject safety locking system without departing from the scope of the present disclosure (e.g., motor-driven locking bolts, servo-driven locking bolts, etc.). Also, although the solenoid assembly is depicted in FIG. 1 as being oriented vertically within housing 102 such that the locking bolt 106 advances through the bottom surface of the housing 102, one or more alternate embodiments can employ a horizontally oriented solenoid assembly such that the locking bolt 106 advances sideways through a vertical surface of the housing.

Safety lock 100 can also comprise a hard stop component disposed within or fabricated into housing 102. The hard stop component includes at least an extended portion 610 that protrudes from a vertical surface of housing 102 that faces the line of travel of the door mounted to door frame 112. Optionally, a latching magnet 608 can be embedded within the front face of the extended portion 610, the purpose of which is explained in more detail infra. In a preferred embodiment, the hard stop component is comprised of metal or other durable material. In one or more embodiments, the extended portion 610 can be a segment of a larger hard stop component disposed within housing 102 and spanning the length of housing 102, thereby affording shock protection to the electrical and mechanical components within the housing 102, as well as protecting the housing itself (which can be made of a plastic material) from impact damage.

Figure 5:
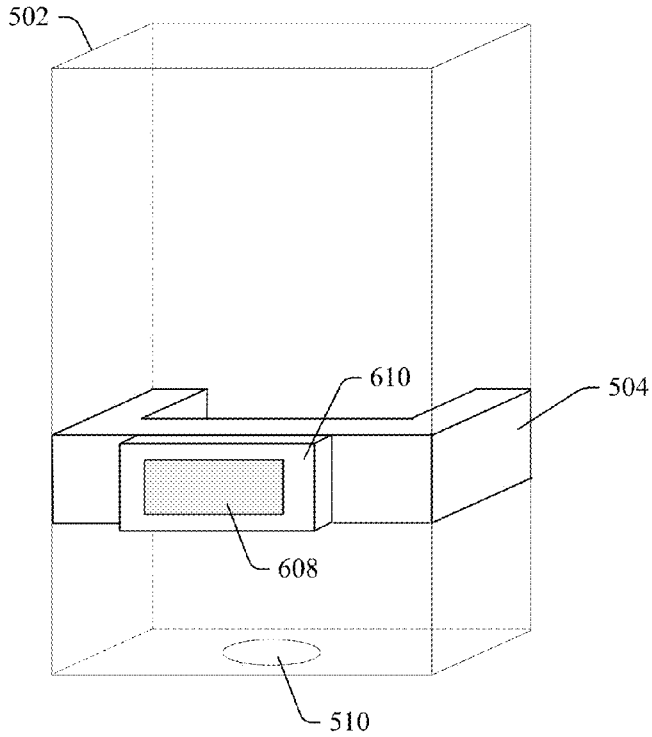
FIG. 5 depicts an exemplary hard stop component disposed within a safety lock housing.

An example of such a hard stop component is illustrated more fully in FIG. 5. FIG. 5 depicts a safety lock housing 502 having an opening 510 on its bottom surface through which a locking bolt (such as locking bolt 106 of FIG. 1) can be extended to facilitate engagement with a locking receptacle. An exemplary hard stop component 504 is disposed within housing 502. The exemplary hard stop component 504 comprises two legs that span from the front surface of safety lock housing 502 to the rear surface, with extended portion 610 containing magnet 608 extending through the front surface of the lock housing 502. If the housing 502 does not have a rear surface (e.g., if the housing acts as a mountable cover for the lock components), the hard stop component 504 can span from the front surface of the housing to a mounting bracket or other fixed component at the rear of the housing. Housing 502 can be mounted to the safety door frame (either directly or using an appropriately designed bracket) such that the extended portion 610 faces the direction of travel of the safety door or gate. By designing hard stop component 504 to span from the front wall of lock housing 502 to the rear wall, door impact shock will be channeled to the door frame and/or the supporting brackets used to mount the safety lock, thereby substantially protecting the electrical and mechanical components contained within housing 502 from shock generated by door impact to the front of housing 502. For plastic housings, the hard stop 504 can also substantially protect the housing itself from damage caused by door impact. It is to be appreciated that the hard stop component 504 illustrated in FIG. 5 is only intended to be exemplary, and that any appropriately shaped hard stop can be employed within housing 502 without deviating from the scope of the present disclosure. Moreover, while the exemplary hard stop component 504 is illustrated as being a separate component disposed within housing 502, one or more alternate embodiments can incorporate hard stop components that are fabricated as part of the housing itself. Such embodiments may be suitable for safety locks having metal housings, since the hard stop can be fabricated as part of the housing itself.

Turning now to FIG. 2, an exemplary receptacle component 200 is illustrated. Receptacle component 200 affixes to a door or gate 202 mounted within door frame 112 of FIG. 1, and is complimentary to safety lock 100, as explained below. Receptacle component 200 can comprise a first plate 606 and a second plate 616 arranged substantially perpendicular to the first plate. A striking plate 212 can also be mounted between receptacle component 200 and door 202. In preferred embodiments, striking plate 212 is made of a ferromagnetic material, while the first plate 606 is made of a non-magnetic material. The purpose of striking plate 212 is explained in more detail infra. First plate 606 can include a cutout or window designed to receive extended portion 610 of the hard stop component when door 202 is closed. A bolt receptacle hole 210 is fabricated into the second plate 616 to receive locking bolt 106 when the bolt is advanced. Advantageously, when door 202 is closed and extended portion 610 is engaged with window 620, accurate alignment between locking bolt 106 of the safety lock 101 and the bolt receptacle hole 210 is assured, as explained in more detail below.

Figure 4:
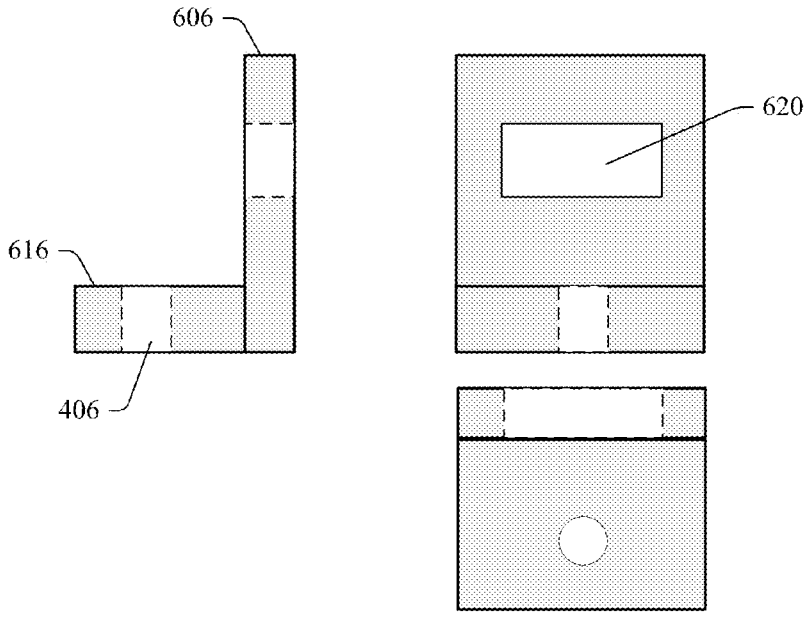
FIG. 4 is a three-view drawing illustrating an exemplary receptacle component.

An exemplary receptacle component is illustrated more clearly in the three-view drawing of FIG. 4. Window 620 is a rectangular window on the first plate 606 of the receptacle component. It is to be appreciated that window 620 need not be rectangular as depicted in FIG. 4. However, it is preferred that window 620 have a shape that is substantially complimentary to that of the extended portion of the hard stop on the safety lock. As noted above, the second plate 616 can include a bolt receptacle hole 406 for receiving the locking bolt of the safety lock when the door is in the closed position and properly aligned. Bolt receptacle hole 406 can be a hole that completely penetrates first plate 616 (as depicted in FIG. 4), or alternatively can be a recessed area having a depth less than the total thickness of the second plate 616. Also, bolt receptacle hole 406 need not be round, as depicted in FIG. 4, but it is preferred that bolt receptacle hole 406 have a shape that is generally complimentary to the locking bolt.

Figure 3:
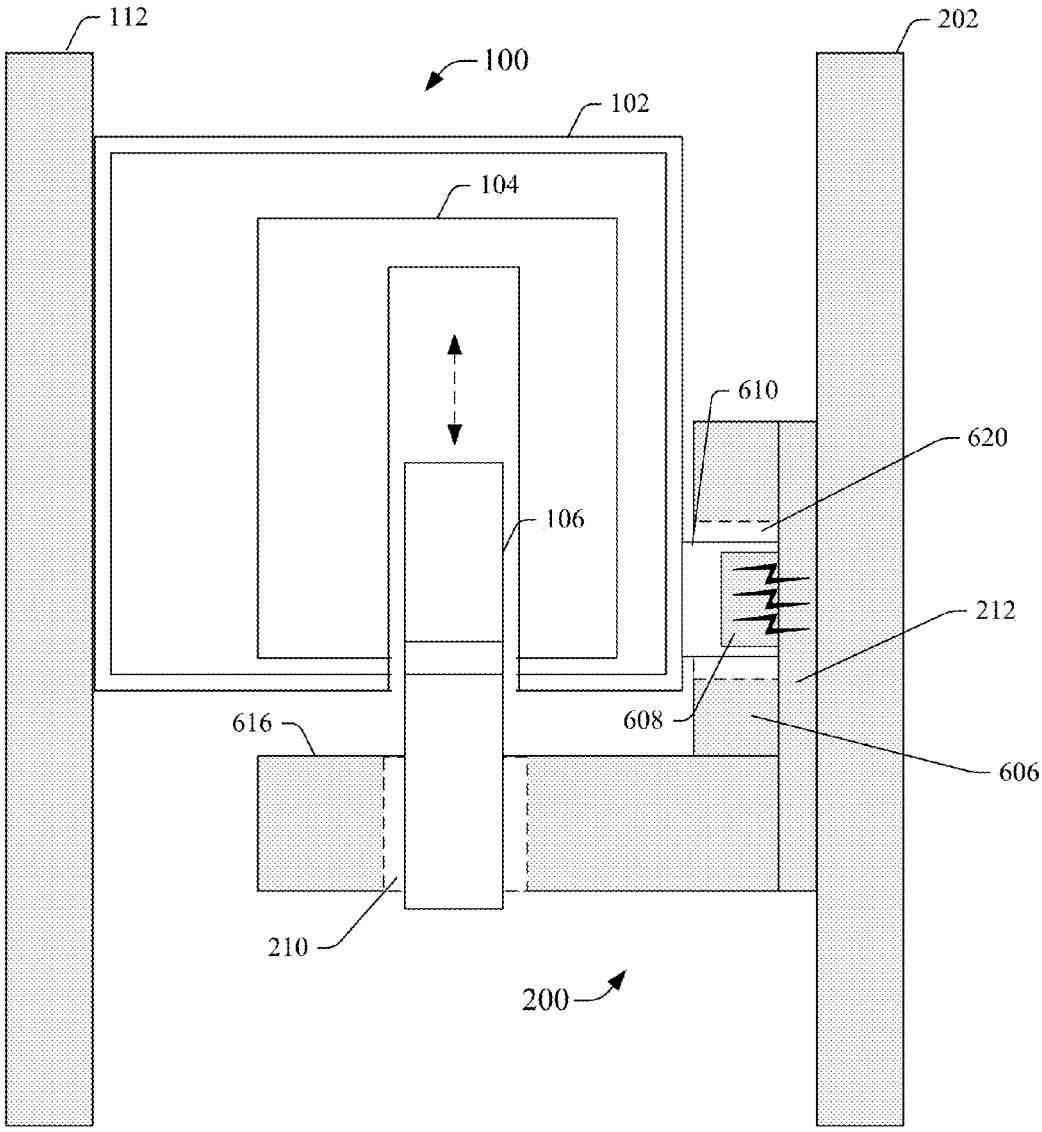
FIG. 3 is a cross-sectional representation depicting the interactions between an exemplary safety lock and corresponding receptacle component when in the closed and locked position.

FIG. 3 illustrates the interactions between safety lock 100 and receptacle component 200 when in the closed and locked position. In this depiction, door 202 is in closed position, bringing receptacle component 200 into contact with safety lock 100, which, together with the hard stop disposed therein (of which extended portion 610 is a part), acts to stop the door at a correct location and serves to limit movement of the door in a first direction. When door 202 is closed, extended portion 610 of the safety lock's hard stop is received by window 620 of the first plate 606 of receptacle component 200. When extended portion 610 is engaged with window 620, movement of the door is substantially limited in four additional directions (that is, the window limits door movement along a plane substantially parallel to the plane of the window). The window 620 is oriented on the first plate such that proper alignment between locking bolt 106 and bolt receptacle hole 210 is assured while extended portion 610 is within the window 620. In one or more embodiments, the clearances between the window 620 and the extended portion 610 are such to allow frictionless travel of the locking bolt 106 through the receptacle hole 210 as long as the hard stop 610 is within the clearances of the window 620. That is, even if the receptacle window 620 is displaced such that the window's edge is against the edge of the extended portion 610, the locking bolt 106 will still be able to stroke through the bolt receptacle hole without touching any portion of the receptacle. To prevent door movement in the sixth direction (e.g., away from the receptacle), magnet 608 can magnetically latch with striking plate 212, thereby latching the magnet to the striking plate (it is to be appreciated that striking plate 212 can be omitted if the door itself is made of a magnetic material). Thus, when door 202 is closed and extended portion 610 is engaged with window 620, movement of the receptacle (and of the door to which it is mounted) is limited in all six direction, allowing locking bolt 106 to be transitioned to the extended position by solenoid 104 and received by bolt receptacle hole 210 in a substantially frictionless manner.

The window 620 of receptacle component 200 together with the extended portion 610 of the hard stop component in safety lock 100 can provide a number of benefits. For one, the window 620 serves to pre-position the second plate 616 for proper engagement with locking bolt 106 by virtue of the window's engagement with the extended portion 610. Once the window 620 is engaged with the extended portion 610, movement of the door 202 is limited in all six directions, ensuring that the locking bolt 106 will accurately engage with bolt receptacle hole 210 when the latter is advanced by solenoid 104. In preferred embodiments, window 620 is sized such that the clearances between the window 620 and the extended portion 610 guarantee proper alignment between the bolt receptacle 210 and the locking bolt 106 as long as the extended portion 610 is located anywhere within window 620 and against the striking plate 212. Moreover, in addition to assisting with proper alignment prior to engaging the locking bolt 106, the window 620 can also improve the integrity of the lock after the locking bolt 106 is engaged with the bolt receptacle hole 210. For example, by sizing the window 620 such that the clearances between the window and the extended portion 610 are less than a length of engagement between the locking bolt 106 and the bolt receptacle 210, window 620 can prevent the second plate 616 from disengaging from the locking bolt 106 due to excessive downward force applied to door 202, since the upper edge of window 620 will come into contact with extended portion 610 before the receptacle is sufficiently displaced to allow the receptacle to slide off the locking bolt. Thus, the subject locking mechanism configuration can thwart attempts to bypass the lock by exerting downward force on the door in an effort to remove the second plate 616 from the bolt 106.

Figure 6:
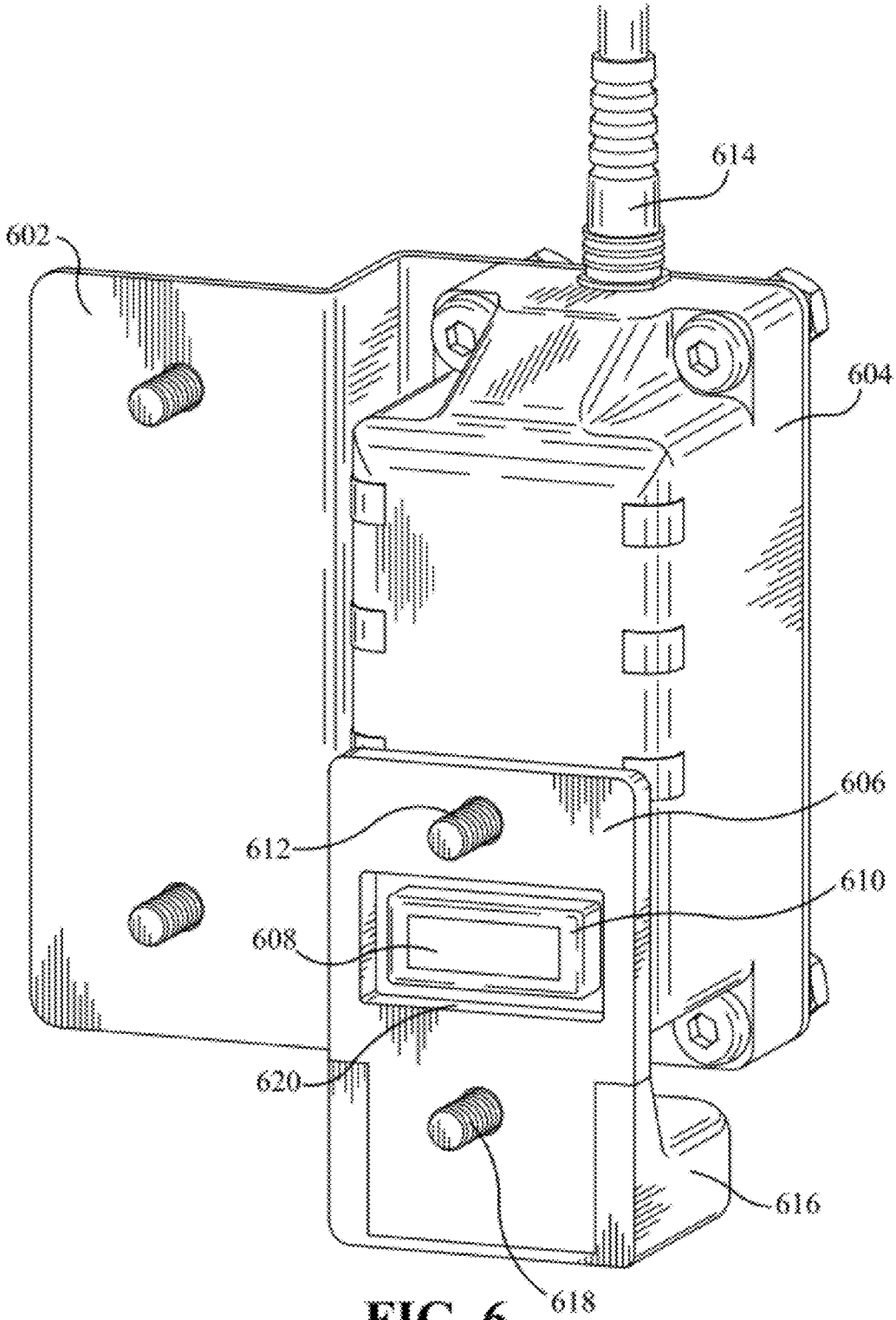
FIG. 6 is a three-dimensional representation of an exemplary safety lock and corresponding receptacle component.

FIG. 6 depicts a three-dimensional representation of an exemplary safety lock and receptacle component according to one or more aspects of the present invention. Safety lock 604 is shown mounted to a bracket 602 that can be used to attach the safety lock to a door rail. The safety lock houses a solenoid-driven locking bolt that advances from the bottom of the lock in response to control signals delivered to the solenoid through cabling 614. A hard stop is disposed within the body of the safety lock 604 as described supra, wherein the hard stop includes an extended portion 610 that protrudes from the front of the safety lock housing. The hard stop can, for example, take the form of hard stop 504 depicted in FIG. 5; however, only the extended portion 610 of the hard stop is visible through the housing in FIG. 6. The extended portion 610 can optionally include a magnetic latch 608 embedded within its front face.

Safety lock 604 is shown engaged with a corresponding receptacle comprising a first plate 606 and a second plate 616. The receptacle mounts to a safety door or gate using mounting bolts 612 and 618. The receptacle's first plate 606 includes an open cutout or window 620 that corresponds with the extended portion 610 of the hard stop mounted within safety lock 604. The receptacle is positioned on the door such that, when the door is closed, window 620 engages with the extended portion 610 of the hard stop, as shown in FIG. 6. Advantageously, since the hard stop within the safety lock 604 spans from the front surface of the lock housing to the rear surface (as illustrated in FIG. 5), the shock resulting from the impact of receptacle against the front surface of the safety lock 604 is substantially transferred to the support bracket 602, protecting the electrical and mechanical components within the safety lock 604 from excessive shock vibration.

While the receptacle is in the closed position depicted in FIG. 6, the safety lock itself acts as a door stop, limiting movement of the door in a first direction (toward the door). The extended potion 610 of the hard stop limits movement of the receptacle in four additional directions (the plane parallel with the front face of the safety lock) by virtue of its engagement with the window 620, since the extended portion 610 acts as a stop against the four edges of the window. This arrangement can, for example, counteract excessive door sagging or warping that might otherwise hinder accurate alignment between the locking bolt and the bolt receptacle hole located on the second plate 616. Moreover, to prevent the door from drifting away from the safety lock prior to advancing the locking bolt (e.g., if the user releases pressure on the door after pushing the door to the closed position), magnet 608 can magnetically adhere to a ferromagnetic striking plate (not shown, but similar to striking plate 212 of FIG. 3) positioned between the receptacle and the door through the window 620, thereby preventing door movement in the sixth direction (it is to be appreciated that the magnet and/or the striking plate can be omitted if the door is configured such that gravity will hold the door in the closed position, as with doors having a horizontal hinge along the top edge). To optimize the magnetic adherence between the magnet 608 and the striking plate, first plate 606 can be fabricated from a non-magnetic material that will not interfere with the magnetic attraction between the magnet 608 and the striking plate.

The clearances between the window 620 and the hard stop 610, and between the locking bolt and the bolt receptacle hole, are such that proper alignment between the locking bolt and the receptacle is guaranteed as long as the window 620 is engaged with the extended portion 610 of the hard stop and the hard stop is against the striking plate (e.g. by virtue of magnet 608, gravitational force, or other means for holding the door against the lock). In preferred embodiments, the alignment offered by these clearances is such that the locking bolt will stroke through the receptacle hole in a frictionless manner without meeting resistance from the sides of the bolt receptacle hole, thereby allowing a low-powered solenoid to be used to actuate the locking bolt. Thus, by limiting movement of the door in all six directions, the illustrated locking system can ensure accurate alignment between the locking bolt and the bolt receptacle prior to advancing the solenoid-driven locking bolt.

It is to be appreciated that variations can be made to the safety lock design described above without departing from the scope of the present disclosure. For example, magnet 608 can be omitted if the door design is such that drifting of the door away from the safety lock is unlikely. Such door designs can include horizontally hinged doors in which the hinge is mounted along the top edge of the door. In this case, gravity will pull the door to a closed position when the door is not held open by an operator or a prop rod, thereby holding the receptacle on the door against the safety lock and mitigating the need for a magnet. In such embodiments, the striking plate can also be omitted from the receptacle, since magnetic latching is not necessary. Moreover, the striking plate itself, if included, can be designed either to have a fixed position behind the receptacle's first plate or to be adjustable, as will be described in more detail below.

The safety lock system described above holds a number of advantages over conventional safety locking systems. The interaction between the receptacle window and the hard stop can simplify accurate door alignment prior to locking, eliminating the need for "trial-and-error" door alignment on the part of the operator. In addition, the consistent and precise alignment offered by the subject safety lock design can reduce or eliminate frictional resistance between the locking bolt and the bolt receptacle (e.g., between the bolt and the edges of the bolt receptacle hole) that can result from imprecise alignment or installation errors, thereby allowing a relatively low-power solenoid to be used to stroke the locking bolt. Moreover, by incorporating the door stopping and door alignment functionalities within the safety lock itself, rather than employing separate brackets or other components to stop and align the door, the number of door assembly components can be reduced. Also, as mentioned above, the engagement of the hard stop with the receptacle window can counter attempts to tamper with the lock after the lock is engaged (e.g., by impeding excessive downward force applied the door in an effort to slide the receptacle off of the locking bolt).

It is also to be appreciated that the safety locking system described herein can be employed in a wide range of safety door or safety gate applications. For hinged safety doors, for example, the receptacle component can be mounted on the hazard-side door surface with the window facing the safety lock, which can itself be mounted to the door frame with the extended portion of the door stop facing outside the enclosed area toward the direction of travel of the door. In such hinged door applications, the hard stop can be particularly useful in counteracting misalignment resulting from excessive door sagging by virtue of the hard stop's engagement with the receptacle window. If the safety door is a sliding door, the receptacle can be mounted on leading edge of the sliding door with the receptacle's window facing the receiving edge of the door frame, while the safety lock can be mounted to the receiving edge with the extended portion of the hard stop facing the leading edge of the door to facilitate engagement with the receptacle's window when the sliding door is in the fully closed position. Since such sliding doors are particularly susceptible to unwanted sideways movement perpendicular to the plane of the door frame (especially if such doors are made of relatively flexible material), the engagement of the hard stop with the receptacle window can advantageously limit such movements when the door is in the closed position and ensure consistent and accurate alignment between the lock and the receptacle.

Figure 7:
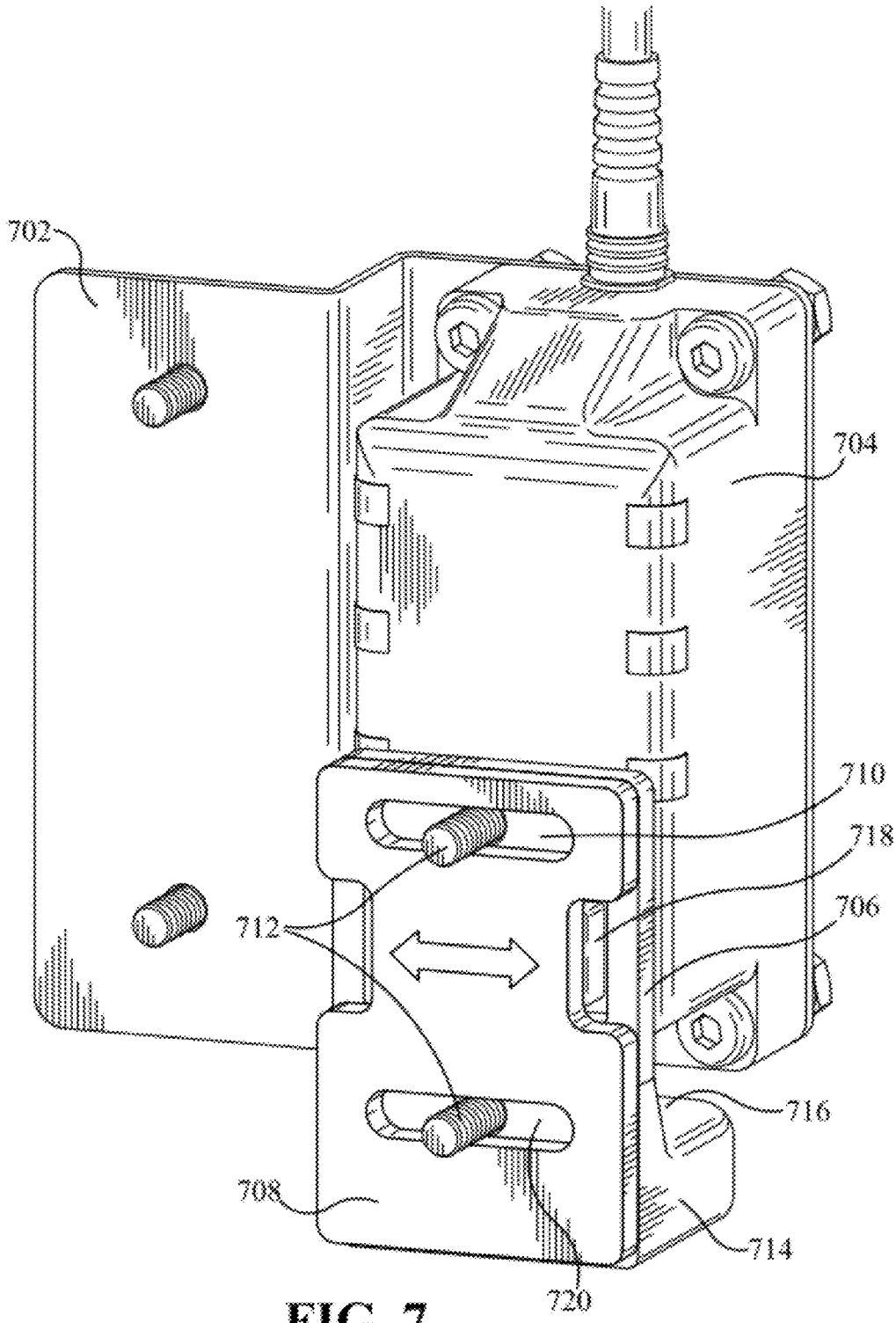
FIG. 7 is a three-dimensional representation of an exemplary safety lock and corresponding receptacle component that includes an adjustable latching plate.

FIG. 7 depicts another exemplary safety lock arrangement in accordance with one or more embodiments of the present invention. Similar to the safety lock system depicted in FIG. 6, this safety lock system comprises a safety lock 704 having disposed therein a solenoid-driven locking bolt (not shown) that advances through the bottom of the safety lock housing to engage with a bolt receptacle 716 on the second plate 714 of a receptacle assembly. Safety lock 704 can be mounted on a safety door frame either directly or using an appropriately designed bracket 702. The receptacle assembly is depicted in the "door closed" position, such that the window of the first plate 706 of the receptacle assembly is engaged with the extended portion 718 of the safety lock's hard stop, as described above. As in some embodiments described supra, a striking plate 708 is mounted between the receptacle assembly and the door. The striking plate 708 is desirably made from a ferromagnetic material to facilitate attraction with the magnet embedded within the extended portion 718 of the safety lock's hard stop.

In this embodiment, rather than having a fixed mounting as with the striking plate described in connection with FIG. 6, striking plate 708 is adjustable in a sideways direction. Striking plate 708 has two horizontal slots 720 and 710 through which the mounting bolts 712 of the receptacle assembly pass before entering the door. This configuration affords the striking plate 708 a degree of sideways movement. Also, the two vertical edges of the striking plate 708 have concavities along their profiles, resulting in a narrowed section substantially corresponding with the section of the striking plate that aligns with the window. In preferred embodiments, the width of this narrowed section is less than the width of the window, but similar to the width of the face of the magnet embedded within hard stop 718. Designing the striking plate 708 in this manner allows the coverage of the magnet's face to be adjusted, thereby changing the strength of attraction between the striking plate and the magnet. For example, FIG. 7 depicts the striking plate in a substantially centered position, resulting in complete coverage of the magnet's face by the striking plate 708. However, sliding the striking plate 708 in either direction reduces the area of the magnet's face that is covered by the striking plate, reducing the strength of the magnetic latching between the magnet and the striking plate.

Figure 8:
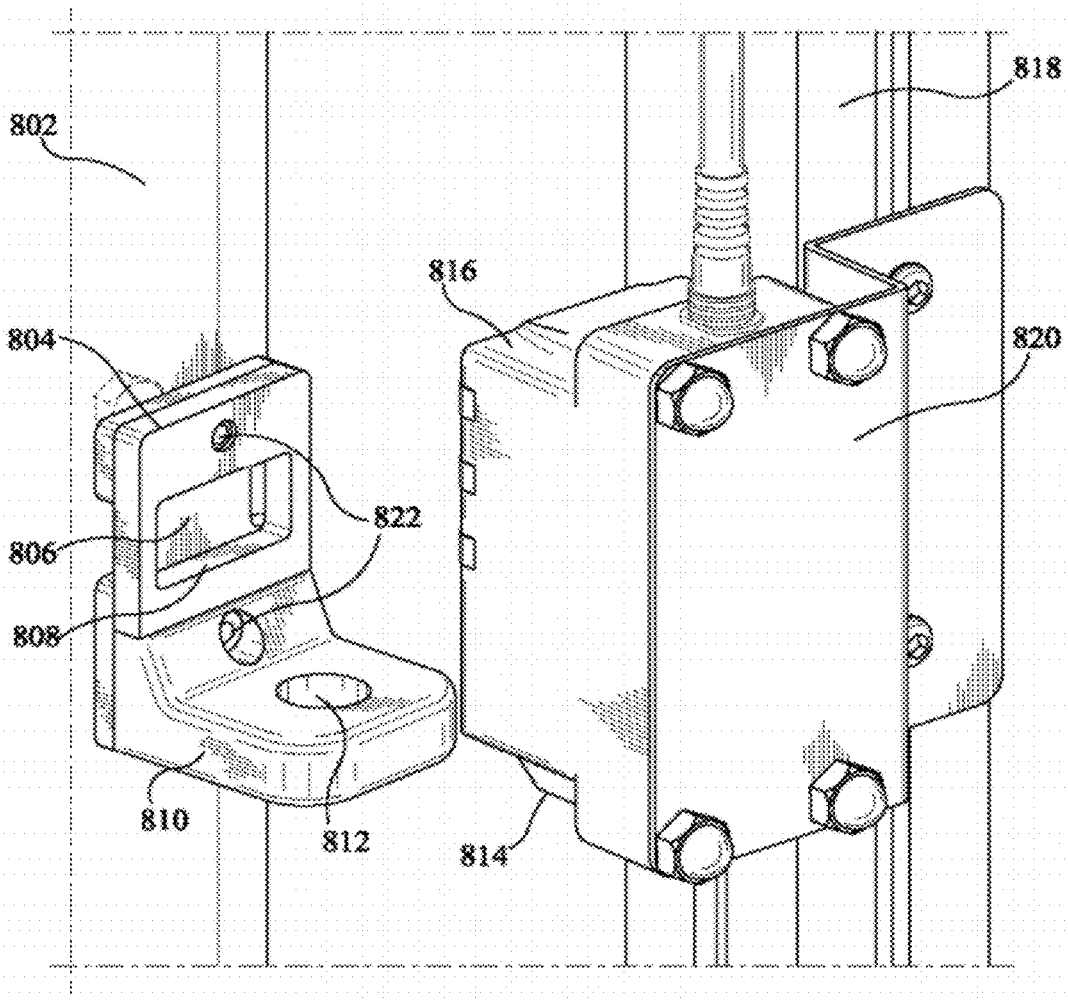
FIG. 8 depicts an exemplary safety lock and corresponding receptacle having an adjustable latching plate mounted respectively to a door rail and a door.

FIG. 8 illustrates another view of the exemplary locking system depicted in FIG. 7. Safety lock 816 is mounted to door rail 818 using bracket 820. A receptacle assembly is mounted to door 802 (shown here opened slightly for clarity). The receptacle assembly includes a first plate 804 having a rectangular cutout or window 808, and a second plate 810 having a bolt receptacle hole 812 for receiving a solenoid-actuated locking bolt (not shown) that advances from the bottom surface 814 of safety lock 816 in response to appropriate electrical signals delivered to the solenoid. It is to be appreciated that the locking bolt need not be solenoid-driven, and that other suitable mechanisms for advancing the locking bolt (e.g. motor, servo, etc.) are within the scope of the present invention.

When door 802 is closed, window 808 serves to pre-position the receptacle assembly to ensure accurate alignment between bolt receptacle 812 and the locking bolt prior to advancing the locking bolt, as described supra. That is, window 808 engages with a portion of a hard stop (not shown) that protrudes from the surface of the safety lock 816 facing the receptacle assembly, and this engagement limits movement of the door 802 (and therefore the receptacle assembly) in four directions. In this embodiment, an adjustable striking plate 806 (similar to adjustable striking plate 708 of FIG. 7) is mounted between the receptacle assembly and the door 802. In preferred embodiments, this striking plate 806 is made of a ferromagnetic material to allow a magnet embedded in the safety lock's hard stop to magnetically latch to the striking plate 806, thereby preventing the door 802 from drifting away from the safety lock 816 before the locking bolt can be engaged with the receptacle. Instead of standard mounting holes, striking plate 806 has two horizontal slots (not shown, but similar to slots 710 and 720 of FIG. 7) through which the receptacle's mounting bolts 822 pass before penetrating the door. These slots allow the face of the striking plate 806 to move sideways with respect to the receptacle assembly. As can be seen, the narrowed portion of striking plate 806 is positioned behind window 806, and is narrower than the width of the window. Adjustment of striking plate 806 in either direction therefore changes the amount of the magnet's surface area that is covered by the striking plate. The horizontal slots of striking plate 806 allow adjustment in either direction in order to accommodate different installation idiosyncrasies and for installation convenience.

Figure 9:
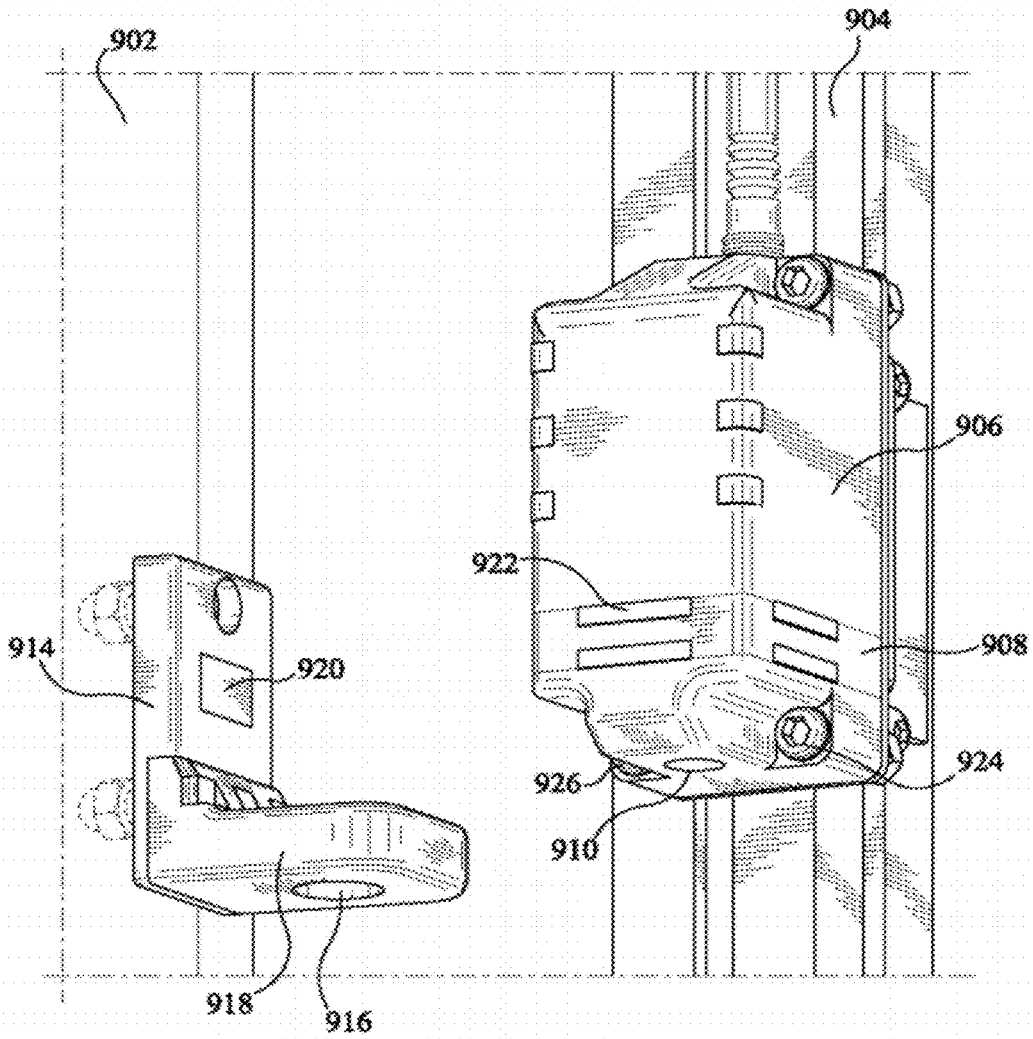
FIG. 9 is a three-dimensional representation of an exemplary safety locking system that allows magnetic latching on three sides of the safety lock housing.
Figure 10:
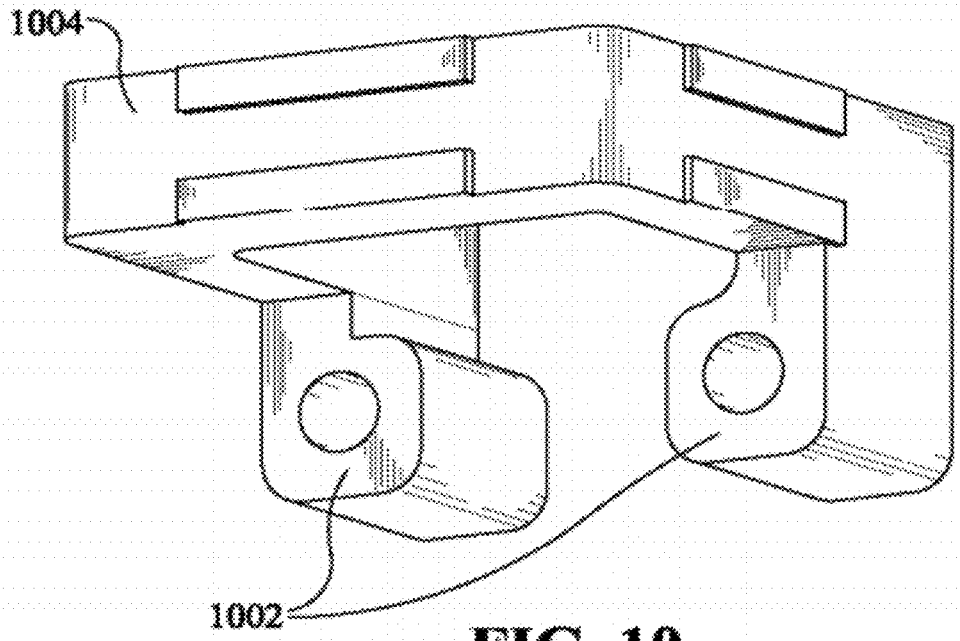
FIG. 10 is a three-dimensional representation of an exemplary hard stop component.

FIG. 9 illustrates an exemplary alternative embodiment of the present safety locking system. As with the embodiments discussed supra, the embodiment illustrated in FIG. 9 incorporates door stopping features within the safety lock itself. This embodiment also emphasizes safety lock mounting flexibility, in that magnetic latching can occur on any of the three non-mounted sides of the safety lock. Safety lock 906 is mounted to door frame 904. A hard stop component 908 is embedded or otherwise disposed within the safety lock 906 such that three surfaces of the hard stop 908 are substantially flush with the three non-mounting surfaces of the safety lock housing. This hard stop component can be seen more clearly in FIG. 10. As can be seen in this figure, the hard stop component comprises a rigid barrier 1004 having three sides corresponding to the three exposed (e.g., non-mounting) surfaces of the safety lock housing, and two mounting legs 1002. Returning now to FIG. 9, it can be seen that the mounting legs 1002 of the hard stop, which is disposed within the safety lock housing, are used to mount the safety lock to the door rail 904 (or to a mounting bracket that affixes the safety lock thereto) using hardware 924 and 926. Thus, the shock generated by door impact on any of the three non-mounting surfaces of safety lock 906 will be channeled through the hard stop 908 and into the door rail 904 (or an associated mounting bracket), providing substantial shock protection to the safety lock housing as well as to the electrical and mechanical components residing therein. The hard stop 908 can allow safety locks to act as their own door stopping mechanism, even if the safety locks comprise housings made of plastic or other relatively brittle material, since the hard stop 908 absorbs a significant amount of door impact shock.

The barrier of hard stop 908 includes a number of metal strips 922 that are exposed on the surface of the safety lock housing. These exposed metal strips 922 facilitate latching with a magnet 920 embedded within the striking plate 914 of the receptacle assembly. When magnet 920 is latched with exposed metal strips 922, movement of the door 902 is limited in two directions (toward and away from safety lock 906). Since latching can be achieved on any of the three exposed surfaces of the safety lock 906, a greater number of mounting options are available. For example, FIG. 9 depicts a mounting configuration wherein the receptacle assembly magnetically latches to the left surface of the safety lock prior to engaging the locking bolt 910. However, safety lock 906 can also be mounted such that the receptacle latches to either of the other two exposed surfaces depending on the requirements of a given door design or installation. Thus, the hard stop 908, working in conjunction with the receptacle assembly, offers shock protection and magnetic latching from three directions, thereby providing installation flexibility.

It is to be appreciated that aspects of the safety lock configuration depicted in FIG. 9 can be combined with alignment features of the other embodiments described herein. For example, although the magnet 920 of FIG. 9 is depicted as being substantially flush with the surface of the striking plate 914 of the receptacle assembly, in some embodiments the magnet 920 can be recessed within the striking plate 914 to yield a window similar to window 620 of FIG*s*. 1-6. Complimentary to this, the sets of metal strips 922 can reside on three extended portions of hard stop 908 that protrude from each of the three non-mounting surfaces of safety lock 906. These extended portions, together with the recessed magnet 920, can confer six-way alignment advantages described above in connection with FIGS. 1-6, with the added benefit of greater installation flexibility. In similar embodiments, each of the three extended portions of the hard stop can include a magnet, and the magnet 920 in the receptacle can be replaced with a window similar to that described above in connection with FIGS. 1-6.

Figure 11:
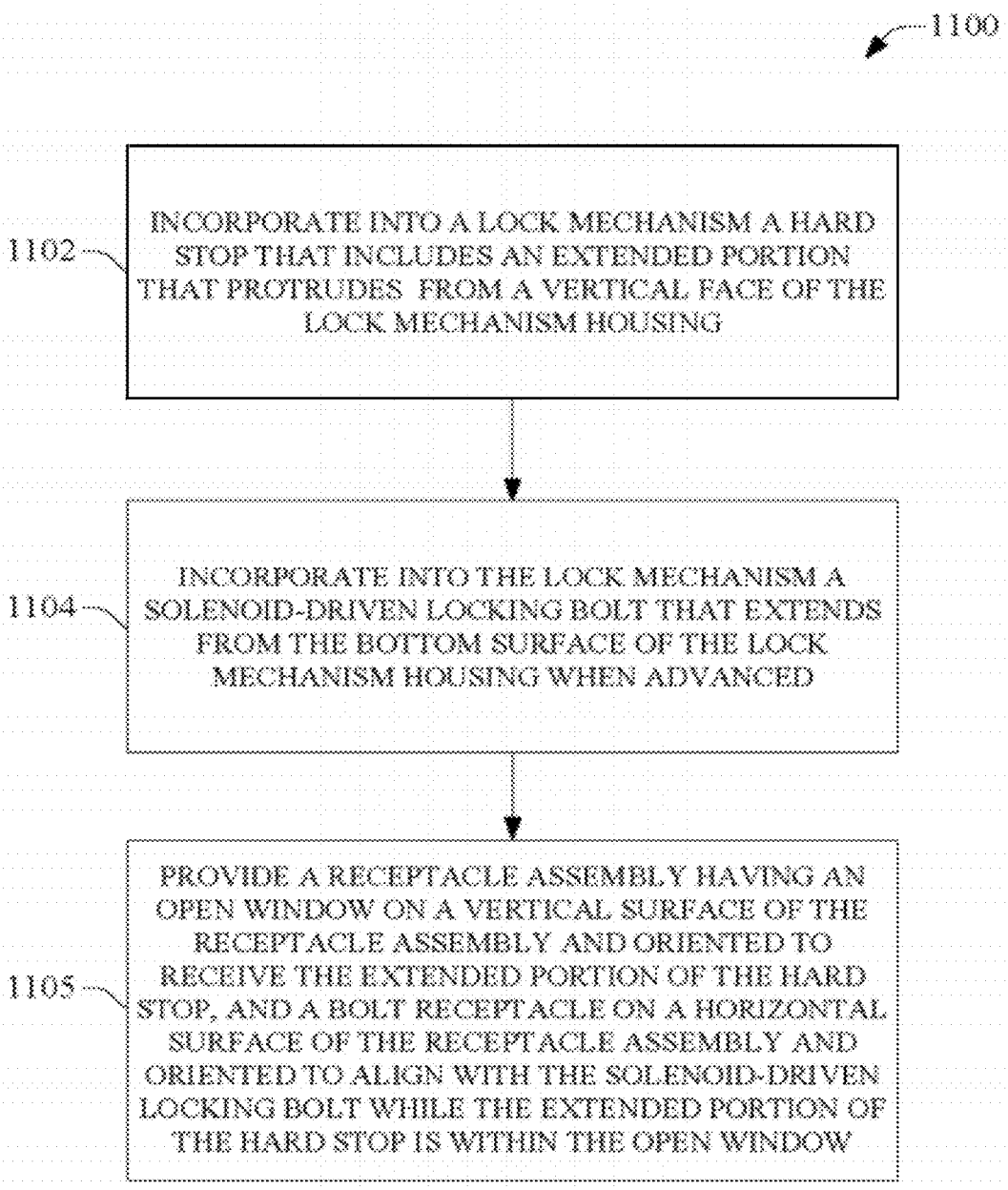
FIG. 11 is a flowchart of an example methodology for incorporating door stopping and door alignment features within a safety lock.
Figure 12:
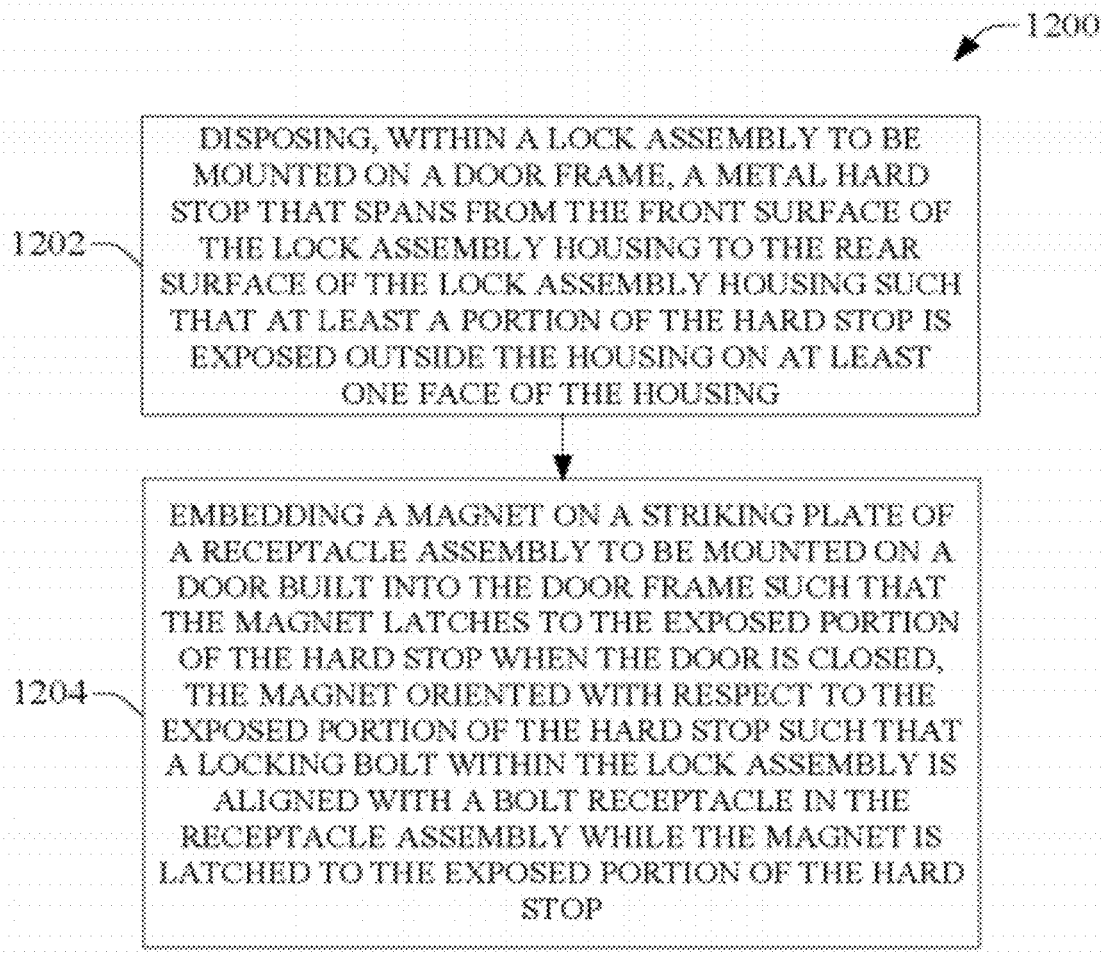
FIG. 12 is a flowchart of an exemplary methodology for fabricating a safety lock mechanism that employs magnetic latching to facilitate receptacle alignment.

FIGS. 11-12 illustrate methodologies in accordance with the claimed subject matter. While, for purposes of simplicity of explanation, the methodologies shown herein are shown and described as a series of acts, it is to be understood and appreciated that the subject innovation is not limited by the order of acts, as some acts may, in accordance therewith, occur in a different order and/or concurrently with other acts from that shown and described herein. For example, those skilled in the art will understand and appreciate that a methodology could alternatively be represented as a series of interrelated states or events, such as in a state diagram. Moreover, not all illustrated acts may be required to implement a methodology in accordance with the innovation. Furthermore, interaction diagram(s) may represent methodologies, or methods, in accordance with the subject disclosure when disparate entities enact disparate portions of the methodologies.

FIG. 11 illustrates an example methodology 1100 for incorporating door stopping and door alignment features within a safety lock. At 1102, a hard stop is incorporated into a lock mechanism, wherein the hard stop includes an extended portion that protrudes from a vertical face of the lock mechanism housing. It is to be appreciated that there can be one or multiple extended portions. For example, one or more embodiments can incorporate a hard stop having an extended portion that protrudes from each non-mounting vertical surface of the lock mechanism housing in order to provide a greater number of lock mounting options. At 1104, a solenoid-driven bolt is incorporated into the lock mechanism such that the locking bolt extends from the bottom surface of the lock mechanism housing when in the advanced position. At 1105, a receptacle assembly is provided having an open window on a first surface of the assembly and oriented to receive the extended portion of the hard stop, and a bolt receptacle on a horizontal surface of the assembly and oriented to align with the solenoid-driven locking bolt while the extended portion of the hard stop is within the open window.

FIG. 12 illustrates an example methodology 1200 for fabricating a safety lock mechanism that employs magnetic latching to facilitate receptacle alignment. At 1202, a metal hard stop is disposed within a lock assembly such that the hard stop spans from the front surface of the lock assembly housing to the rear surface. The rear surface can, for example, comprise the surface of the lock assembly that mounts to a door frame or a mounting bracket. The hard stop can be disposed within the lock housing such that at least a portion of one or more outward facing surfaces of the hard stop is exposed outside the housing. The lock assembly can include a locking bolt (e.g. a solenoid-driven bolt) that advances and retracts through an opening in the lock assembly housing and that is designed to engage with a bolt receptacle. At 1204, a magnet is embedded in a striking plate of a receptacle assembly to be mounted on a door. The magnet can be oriented on the striking plate such that the magnet latches to an exposed portion of the hard stop when the door is in the closed position. Moreover, the magnet and the exposed portions of the hard stop can be oriented within their respective components such that alignment between the locking bolt and the bolt receptacle is achieved while the magnet is latched with the exposed portion of the hard stop.

What has been described above includes examples of the subject innovation. It is, of course, not possible to describe every conceivable combination of components or methodologies for purposes of describing the disclosed subject matter, but one of ordinary skill in the art may recognize that many further combinations and permutations of the subject innovation are possible. Accordingly, the disclosed subject matter is intended to embrace all such alterations, modifications, and variations that fall within the spirit and scope of the appended claims.

In particular and in regard to the various functions performed by the above described components, devices, circuits, systems and the like, the terms (including a reference to a "means") used to describe such components are intended to correspond, unless otherwise indicated, to any component which performs the specified function of the described component (e.g., a functional equivalent), even though not structurally equivalent to the disclosed structure, which performs the function in the herein illustrated exemplary aspects of the disclosed subject matter. In this regard, it will also be recognized that the disclosed subject matter includes a system as well as a computer-readable medium having computer-executable instructions for performing the acts and/or events of the various methods of the disclosed subject matter.

In addition, while a particular feature of the disclosed subject matter may have been disclosed with respect to only one of several implementations, such feature may be combined with one or more other features of the other implementations as may be desired and advantageous for any given or particular application. Furthermore, to the extent that the terms "includes," and "including" and variants thereof are used in either the detailed description or the claims, these terms are intended to be inclusive in a manner similar to the term "comprising."

The invention claimed is:

1. A locking system, comprising:

a hard stop configured to reside within a lock housing, wherein the hard stop has an extended segment that protrudes from a first surface of the lock housing; and a receptacle comprising a first plate having a window configured to receive the extended segment, and a second plate attached to and substantially perpendicular to the first plate, wherein the second plate has a bolt receptacle hole configured to receive a locking bolt that advances from a second surface the lock housing to facilitate locking between the lock housing and the receptacle, and wherein engagement of the extended segment with the window causes the bolt receptacle hole to substantially align with the locking bolt.

2. The locking system of claim 1, wherein the hard stop is disposed within the lock housing and substantially spans from a first wall of the lock housing to a second wall of the lock housing, and wherein the second wall is opposite the first wall.

3. The locking system of claim 1, wherein the extended segment has a magnetic latch embedded therein.

4. The locking system of claim 1, wherein the first plate is configured to mount to a surface.

5. The locking system of claim 1, wherein the hard stop is at least one of a separate component from the lock housing or fabricated as part of the lock housing.

6. The locking system of claim 1, wherein the receptacle further comprises a striking plate configured to mount between the surface and the first plate.

7. The locking system of claim 6, wherein the striking plate is configured to be adjustable in a sideways direction relative to the window.

8. The locking system of claim 1, wherein the locking bolt is at least one of solenoid-driven, motor-driven, or servo-driven.

9. A method for locking a door, the method comprising:

receiving, in a window of a first plate of a receptacle component, an extended segment of a hard stop, wherein the hard stop resides within a lock housing, wherein the extended segment protrudes from a first surface of the lock housing, and wherein the receiving of the extended segment of the hard stop in the window causes a bolt receptacle hole of a second plate of the receptacle component to substantially align with a locking bolt that advances from a second surface of the lock housing, the second plate being substantially perpendicular to the first plate; and extending the locking bolt from the second surface of the lock housing causing the locking bolt to advance through the bolt receptacle hole to facilitate latching the lock housing to the receptacle component.

10. The method of claim 9, wherein the receiving comprises receiving the extended segment of the hard stop wherein the hard stop substantially spans from a first wall of the lock housing to a second wall of the lock housing that is opposite the first wall.

11. The method of claim 9, further comprising magnetically latching the extended segment to the receptacle component via a magnetic latch embedded within the extended segment.

12. The method of claim 9, further comprising:

mounting the lock housing to a door frame; and mounting the receptacle component to one of a door or a gate.

13. The method of claim 12, wherein the receiving comprises receiving the extended segment wherein the extended segment contacts a striking plate mounted between the first plate and a surface of the one of the door or the gate.

14. The method of claim 13, further comprising adjusting the striking plate in a sideways direction relative to the window.

15. The method of claim 9, wherein the receiving comprises receiving the extended segment of the hard stop wherein the hard stop is a separate component from the lock housing.

16. The method of claim 9, wherein the receiving comprises receiving the extended segment of the hard stop wherein the hard stop is fabricated as part of the lock housing.

17. The method of claim 9, wherein the extending comprises extending the locking bolt using at least one of a solenoid, a motor, or a servo.

18. A system for locking a door, the system comprising:

means for extending a locking bolt from a first surface of a lock housing;

means for receiving the locking bolt in response to extension of the locking bolt from the first surface of the lock housing to facilitate latching the lock housing to the means for receiving the locking bolt; and means for receiving an extended segment of a hard stop that is disposed within the lock housing, wherein the extended segment protrudes from a second surface of the lock housing, and wherein reception of the extended segment by the means for receiving the extended segment causes substantial alignment between the locking bolt and the means for receiving the locking bolt.

19. The system of claim 18, wherein the means for receiving the locking bolt is substantially perpendicular to the means for receiving the extended segment.

20. The system of claim 18, further comprising means for magnetically latching the extended segment to the means for receiving the extended segment.

* * * * *